United States Patent [19]

Pistek

[11] Patent Number: 5,044,524

[45] Date of Patent: Sep. 3, 1991

[54] PRESSURIZED DISPENSING CONTAINER

[76] Inventor: Václav Pistek, 497 HlavníHluk, Czechoslovakia

[21] Appl. No.: 469,939

[22] Filed: Jan. 25, 1990

[30] Foreign Application Priority Data

Jan. 27, 1989 [CS] Czechoslovakia ..... 538-89

[51] Int. Cl.[5] ..... B67D 5/06

[52] U.S. Cl. ..... 222/212; 222/386.5

[58] Field of Search ..... 222/212, 206, 215, 131, 222/105, 386.5; 239/321, 322, 323

[56] References Cited

U.S. PATENT DOCUMENTS

| | | | |
|---|---|---|---|
| 3,225,967 | 12/1965 | Heimgartner | 222/206 |
| 3,796,356 | 3/1974 | Venus, Jr. | 222/212 |
| 3,876,115 | 4/1975 | Venus, Jr. et al. | 222/212 |
| 3,940,026 | 2/1976 | Kain | 222/212 |
| 4,121,737 | 10/1978 | Kain | 222/212 |
| 4,324,350 | 4/1982 | Thompson | 222/212 |
| 4,423,829 | 1/1984 | Katz | 222/212 |

*Primary Examiner*—Andres Kashnikow
*Assistant Examiner*—Lesley D. Morris
*Attorney, Agent, or Firm*—Notaro & Michalos

[57] ABSTRACT

A pressurized dispensing container comprises a protective flask having a neck and a lid provided with a discharging pressure valve, and designed especially for dispensing hair lacquer, perfume, shaving cream, liquid soap, tooth paste, disinfectants, oils ketchup and mustard. The flask is provided in its interior with a closed resilient hollow body (7) provided about its periphery with at least one bead (6) serving for sealing the body (7) between the neck (4) of the protective flask (1) and the lid (9) thereof with the filling and discharging pressure valve.

9 Claims, 1 Drawing Sheet

PRESSURIZED DISPENSING CONTAINER

FIELD AND BACKGROUND OF THE INVENTION

The invention relates to a pressurized container comprising a protective flask having a neck and a lid provided with a discharging pressure valve, and designed especially for dispensing hair lacquer, perfume, shaving cream, liquid soap, tooth paste, disifectants, oils, ketchup and mustard.

In known pressurized containers, especially aerosol containers for dispensing various substances, freon is used as the discharge filler. The noxious effects of freon, which in particular influences the protective ozone layer about the earth, are well known.

In some cases, especially when atomizing perfumes, pressurized containers are used which are provided with a push-button pump to be controlled by a users finger. Such a manual control, however, which has to be repeatedly applied, does not constitute an equivalent of a container which can provide a continuous discharge of a substance by merely depressing a pressure valve of a pressurized freon-filled container.

SUMMARY OF THE INVENTION

It is an object of the present invention to eliminate or at least mitigate the drawbacks of the prior art as hereinabove referred to, and to provide an improved pressurized dispensing container consisting of a protective flask having a neck and a lid provided with a discharging pressure valve, and designed especially for dispensing hair lacquer, perfumes, shaving cream, liquid soap, tooth paste, disinfectants, oils, ketchup and mustard.

according to an aspect of the invention, the container receives a closed resilient hollow body provided about its periphery with at least one bead serving for sealing said body between the neck of the protective flask and the lid thereof with the filling and discharging pressure valve.

The closed resilient hollow body is preferably made, at one side of the bead, of a thicker elastic material than at the other side thereof, or of a material having at either side of the bead a different coefficient of elasticity.

Further it is advantageous when a portion of the closed resilient hollow body is greater at one side of the bead than its portion at the other side thereof.

a merit of the present invention, involving protection of the environment, resides in that it does not use freon as the discharge filling of the container, but on the other hand, it provides, with the same manipulation, for identical effects of the pressurized container, irrespective of the fact that the substance is dispensed in the form of aerosol, foam, or merely extruded. Apart from this, the absence of explosion danger, when handling the container at elevated temperatures, may also not be disregarded.

Another advantage of the invention lies in the use of a double bag in the form of a single closed resilient hollow body, thus enabling the pressurized dispensing container to be easily assembled, and the whole substance volume to be completely discharged.

BRIEF DESCRIPTION OF THE DRAWINGS

A preferred embodiment of the invention will hereinafter be described with reference to the accompanying schematic drawing in which.

Figure 1:
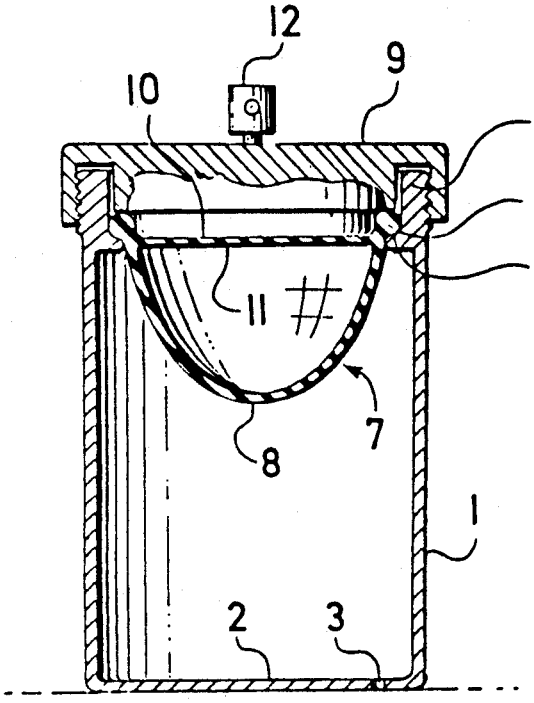
FIG. 1 shows an empty pressurized dispensing container in a vertical axial section.
Figure 2:
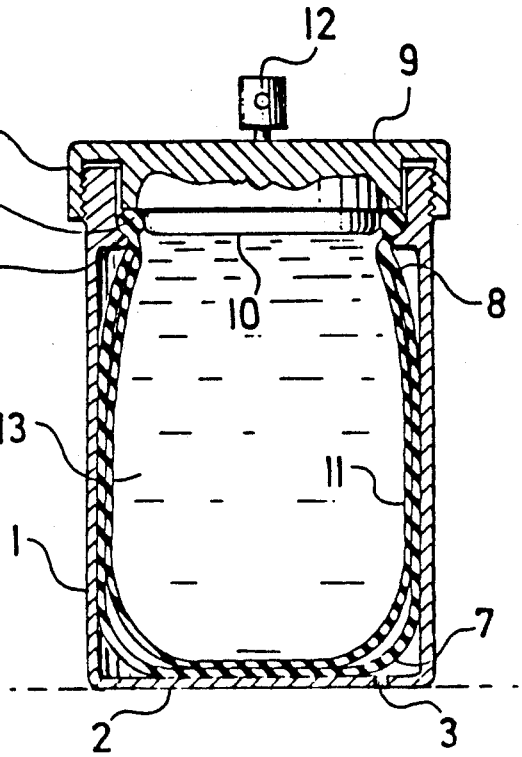
FIG. 2 is a similar view showing the full container.
Figure 3:
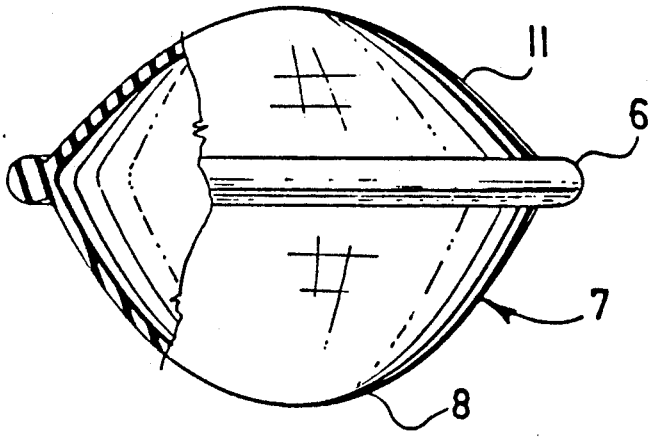
FIG. 3 is a similar view showing the closed resilient hollow body removed from the container. cl DESCRIPTION OF THE PREFERRED EMBODIMENT The pressurized dispensing container comprises a protective flask 1 which is made of aluminium or a plastic material and which is provided, for instance in its bottom 2, with a deaerating vent 3 and, in its top part, with a neck 4. The neck is formed, about its inner periphery, as a circular seat or shoulder 5 which is upwardly open and which serves for receiving a bead 6 of a closed resilient hollow body 7 whose lower portion 8 in the form of an air bag enters the interior of the protective flask 1 as shown in FIG. 1. The neck 4 is covered by a lid 9 which, by a bottom peripheral ledge and the peripheral part of its lower surface 10, bears on the bead 6 of the hollow body 7 while, if the container is empty, the upper portion 11 of the body 7 bears on the surface 10 of the lid 9. The lid 9 is secured to the neck 4 of the protective flask in any conventional way such as a threaded joint, circumferential saw-tooth depressions and projections, or by press fit. In the lid 9 there is arranged a usual filling and discharging pressure valve (not shown) which is provided with the respective nozzle 12 of the atomizing, foaming, or only extruding type. The closed resilient hollow body 7 can be filled with air of at normal atmospheric pressure, or, depending on the consistency of the substance 13 to be dispensed, with air at above atmospheric pressure. Depending upon the substance consistency, the body 7 can be made of two types of material having either different thicknesses, or different elasticity coefficients, or can be asymmetric relative to the bead 6.

When assembling the pressurized dispensing container, the closed resilient hollow body 7 is inserted with its lower portion 8 first, into the interior of the protective flask 1, until the bead 6 thereof engages the circular seat 5 in the flask neck 4. The lid 9 is then put on the neck 4 and the upper portion 11 of the closed resilient hollow body 7, is forced through the neck 4 of the protective flask 1 whereupon the lid 9 is secured, e.g. by screwing on, whereby the bead 6 of the body 7 is firmly clamped between the bottom peripheral ledge of lid 9, the periphery of lower surface 10, and the seat 5.

The filling of the assembled pressurized container with the substance 13 to be dispensed, such as hair lacquer, perfume, shaving cream, liquid soap, tooth paste, disinfenctants, oil, ketchup or mustard, is effected in a usual way through the filling and discharging pressure valve arranged in the lid 9. When being supplied, the substance 13, due to its overpressure, expands the upper portion 11 of the following body 7 into the flask and away from the lower surface 10 of the lid 9. The air in the interior of the body 7, is simultaneously compressed. The increasing volume of the substance 13 to be dispensed causes also the lower portion 8 of the hollow body 7 to be expanded, until said portion 8 finally engaged the inner wall of the protective flask 1. Air contained in the flask interior is simultaneously expelled during the filling process through vent 3. After the pressurized container has been supplied with a desired volume of the substance 13 to be dispensed, the filling is stopped. By filling the pressurized container with the substance there is generated an energy necessary for extruding said substance; the energy is accumulated, on the one hand, in the material, of the upper and the lower portion 11 and 8, respectively, of the closed resilient hollow body 7, and, on the other hand, in the air compressed in the interior of said body 7.

After putting on a suitable nozzle 12, the filling and discharging pressure valve (not shown) is released by depressing said nozzle, and, due to the co-action of all of the energies, the substance 13 to be dispensed is atomized, foamed or merely extruded out of the pressurized container while, as the substance volume decreases, air is sucked in from the ambient atmosphere into the interior of the protective flask 1 through the deaerating vent 3.

The pressurized dispensing container constitutes an equivalent of freon-filled containers and, depending upon the kind of elastic material for manufacturing the closed resilient hollow body, it is also capable of use in the foodstuff industry.

What I claim is:

1. A pressurized dispenser comprising:

a protective flask having a neck defining an opening;

a resilient hollow body defining a closed gas filled space and having a periphery with at least one bead therearound, said bead being engaged against at least a portion of said neck, said hollow body being disposed in said flask with said space being out of communication with said neck opening; and a lid containing a discharging pressure valve therein, said lid being fixed to said flask for closing the opening of said flask, at least a portion of said lid being engaged against said bead for firmly fixing said bead between said neck and said lid and for forming a seal for said flask between said lid and said neck, said lid and valve being out of communication with said space.

2. A container according to claim 1, wherein said resilient hollow body comprises an upper portion and a lower portion, said upper and lower portions being connected to each other at said bead, one of said upper and lower portions being made of thicker elastic material than the other of said upper and lower portions.

3. A container according to claim 1, where said resilient hollow body comprises an upper portion and a lower portion, said upper and lower portions being connected to each other at said bead, one of said upper and lower portions being made of elastic material having a different coefficient of elasticity than the other of said upper and lower portions.

4. A container according to claim 1, wherein said resilient hollow body comprises an upper portion and a lower portion, said upper and lower portions being connected to each other at said bead, one of said upper and lower portions being larger than the other of said upper and lower portions.

5. A container according to claim 1, wherein said resilient hollow body contains air which is pressurized when the container is filled with material to be dispensed through the valve of the lid, for deforming said resilient hollow body into said flask in a direction away from said lid.

6. A container according to claim 1, wherein said neck includes a circular seat around the opening of said flask, said lid including a bottom ledge and a bottom surface having an outer periphery, said bead being clamped between said seat, said bottom ledge and said outer periphery.

7. A container according to claim 6, wherein said flask includes a vent at an end thereof opposite from said opening.

8. A container according to claim 7, wherein said resilient hollow body comprises upper and lower elastic portions which are connected together by said bead, said elastic portions together defining an interior space filled with air.

9. A container according to claim 1, wherein said resilient hollow body in its completely undeformed condition outside of said protective flask, comprises an upper upwardly domed portion and a lower downwardly domed portion, said upper and lower portions being connected to each other at said bead, and with said resilient hollow body in said protective flask, and said lid fixed to said flask, said upper portion being flattened against said lid in preparation for a filling of said dispenser, said dispenser being fillable with fluid through said valve over said upper and lower portions of said hollow body to deform said upper and lower portions of said hollow body away from said lid and outwardly toward said flask.

* * * * *